US005291654A

United States Patent [19]

Judd et al.

[11] Patent Number: 5,291,654

[45] Date of Patent: Mar. 8, 1994

[54] METHOD FOR PRODUCING HOLLOW INVESTMENT CASTINGS

[75] Inventors: James A. Judd, Ellington; Zaffar A. Razzaq, Glastonbury, both of Conn.

[73] Assignee: United Technologies Corporation, Hartford, Conn.

[21] Appl. No.: 38,394

[22] Filed: Mar. 29, 1993

[51] Int. Cl.[5] ..... B23P 15/00

[52] U.S. Cl. ..... 29/889.721; 29/889.72; 164/122.1

[58] Field of Search ..... 29/889.7, 889.72, 889.721, 29/889.722, 527.6; 164/122.1, 122.2, 361, 516

[56] References Cited

U.S. PATENT DOCUMENTS

| | | | |
|---|---|---|---|
| 3,628,237 | 12/1971 | Ziegler | 29/527.6 |
| 3,965,963 | 6/1976 | Phipps et al. | 164/122.1 |
| 3,981,344 | 9/1976 | Hayes et al. | 164/361 |
| 4,068,702 | 1/1978 | Herold | 164/122.1 |
| 4,078,598 | 4/1978 | Kelso et al. | 164/122.1 |
| 4,093,017 | 6/1978 | Millin, Jr. et al. | 164/361 |
| 4,331,895 | 5/1982 | Edick et al. | 310/61 |
| 4,416,321 | 11/1983 | Goddard et al. | 164/122.1 |
| 4,417,381 | 11/1983 | Higginbotham | 29/889.721 |
| 4,487,246 | 12/1984 | Frasier | 164/122.1 |
| 4,561,491 | 12/1985 | Slack | 164/122.1 |
| 4,596,281 | 6/1986 | Bishop | 164/122.1 |
| 4,811,778 | 3/1989 | Allen et al. | 29/889.7 |

*Primary Examiner*—Irene Cuda

*Attorney, Agent, or Firm*—Charles E. Sohl

[57] ABSTRACT

A method for casting metering holes connecting the inner and outer surfaces of hollow investment cast objects, such as hollow air cooled gas turbine airfoils. The method incorporates mini cores having metering hole pins which extend further into the inner cavity than the surface of the cavity, so that the ends of the holes can be exposed by a subsequent machining operation. The method also includes forming a wax pattern which avoids contact between the wax and the metering hole pins so that the pins are not broken by the wax during the heatup portion of the wax removal step after formation of the ceramic casting mold.

2 Claims, 2 Drawing Sheets fig. 1
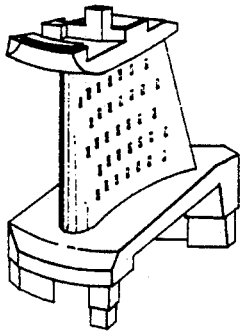
fig. 2
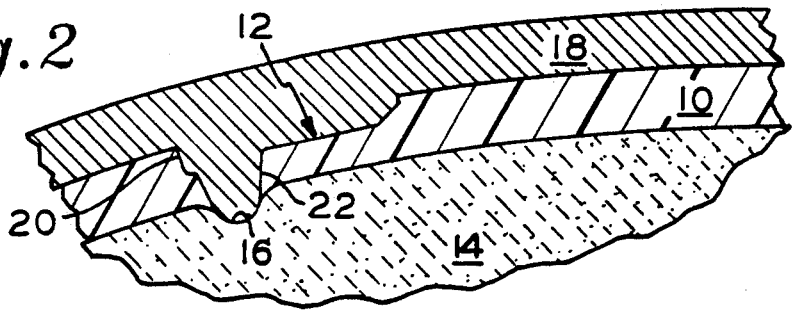
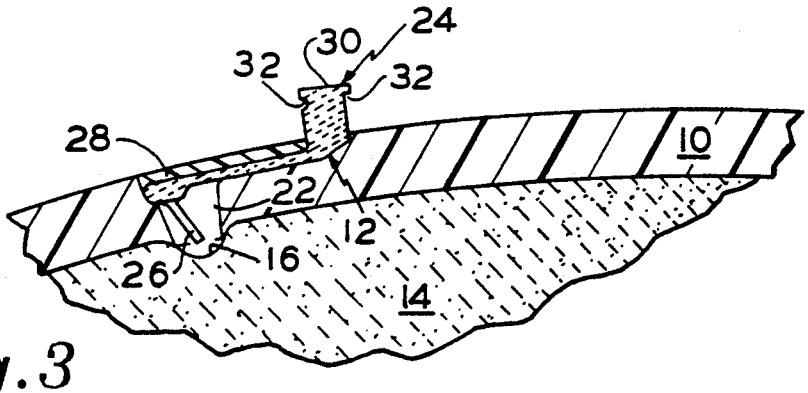
fig. 3

METHOD FOR PRODUCING HOLLOW INVESTMENT CASTINGS

TECHNICAL FIELD

The present invention relates to manufacture of cast articles having internal passages therein, and relates particularly but not exclusively to a method of casting turbine airfoils with internal cooling passages therein.

BACKGROUND ART

Investment casting is a well-known technique for producing articles having, among other features, internal cavities. The cavities may be necessary for weight reduction, containment capacity or flow-through capability. The investment casting process has been found to be very useful for fabrication of complex metal castings, especially those having hollow internal cavities. By properly supporting patterns made of an easily removable substance, such as wax, very complex internal configurations can be produced.

Gas turbine engines utilize hollow components, primarily for weight reduction and for cooling capability. Cooling is achieved by flowing bleed air through some of the components, particularly airfoils such as blades and vanes in the turbine section, where the highest operating temperatures are encountered, and where the efficiency of the engine is most limited by the capability of the materials to withstand the effects of high temperatures. By appropriate cooling, the operating temperatures can be raised to levels which would otherwise destroy, or severely shorten the lifetime of, uncooled components. A typical air cooled vane is shown in FIG. 1.

In addition to flowthrough cooling, air is frequently bled from the internal cavity through the airfoil walls so that it flows over the outer surface of the airfoil to provide film cooling. Common methods of forming the air outlets through the airfoil walls include electron beam and laser drilling, and electrical discharge machining (EDM). While these techniques have been successfully employed for many years, the cooling passages are essentially restricted to a line-of-sight configuration. They also require extra manufacturing steps, involving time-consuming and labor intensive processes, and are thus very expensive.

Techniques have been developed whereby ceramic mini cores are embedded in the wax patterns so that, when the wax patterns are removed after formation of the ceramic mold around the wax pattern, the mini cores remain as part of the mold and define the pathways through the airfoil component by which the cooling air flows from the inner cavity of the airfoil to its outer surfaces.

To achieve the proper cooling of the airfoil without diverting excessive incoming air, which would adversely affect the efficiency of engine operation, very close tolerance metering holes are required to control the amount of air flowing through the cooling passages.

Initial attempts at casting the metering holes, using extensions of the mini core which form the metering holes, hereinafter called metering hole pins, resulted in excessive breakage of the metering hole pins, which seemed to occur during the wax removal portion of the mold fabrication process. These difficulties encountered with casting in of the metering holes initially dictated that the metering holes be formed after the casting process, generally by an EDM technique. Again the extra manufacturing steps required are time consuming and expensive.

Thus it is necessary to have a method of casting in the metering holes so that a simple machining operation opens the holes to air flow. It is further necessary to have a method which permits formation of the investment casting mold without damaging the metering hole pins.

DISCLOSURE OF INVENTION

The present invention solves these problems by eliminating the contact between the metering hole pins and the wax which forms the pattern for casting the airfoil. The invention process incorporates a wax pattern in which the receptacle for receiving the mini cores has an enlarged portion into which the metering hole pins are placed without contacting the wax pattern. The mini cores are then sealed in position in the receptacles so that the ceramic slurry, from which the mold is made, does not flow into the metering hole pin receptacle and surround the metering hole pins during the mold making operation. This assures that the mold material will not contact the metering hole pins, a requirement which would otherwise have to be satisfied by the wax pattern.

The enlarged pin cavity is shaped such that, after the wax pattern is removed, commonly by heating to melt or burn it out, and the investment casting is made, metal will completely surround the pins in the enlarged pin receptacle portion and form protrusions on the inner surface of the hollow casting. The pins which form the metering holes are completely covered by metal during the casting process. The length of the pins is sufficient that the metering holes formed by the pins during the casting process extend toward the center of the hollow airfoil beyond the finish dimension of the airfoil cavity. Removal of all or a portion of the protrusions by any of several common techniques exposes and opens the blind ends of the metering holes, thus opening the pathway for flow of cooling air from the inside to the outside surfaces of the airfoil.

These, and other features and advantages of the invention, will be apparent from the description of the Best Mode, read in conjunction with the drawings.

BRIEF DESCRIPTION OF DRAWINGS

FIG. 1 is a perspective view of a typical hollow air cooled gas turbine engine turbine vane.

FIG. 2 is a partial cross section of the mold for forming the wax pattern.

FIG. 3 is a partial cross section showing the positioning of the mini cores in the wax pattern.

BEST MODE FOR CARRYING OUT THE INVENTION

Figure 4:
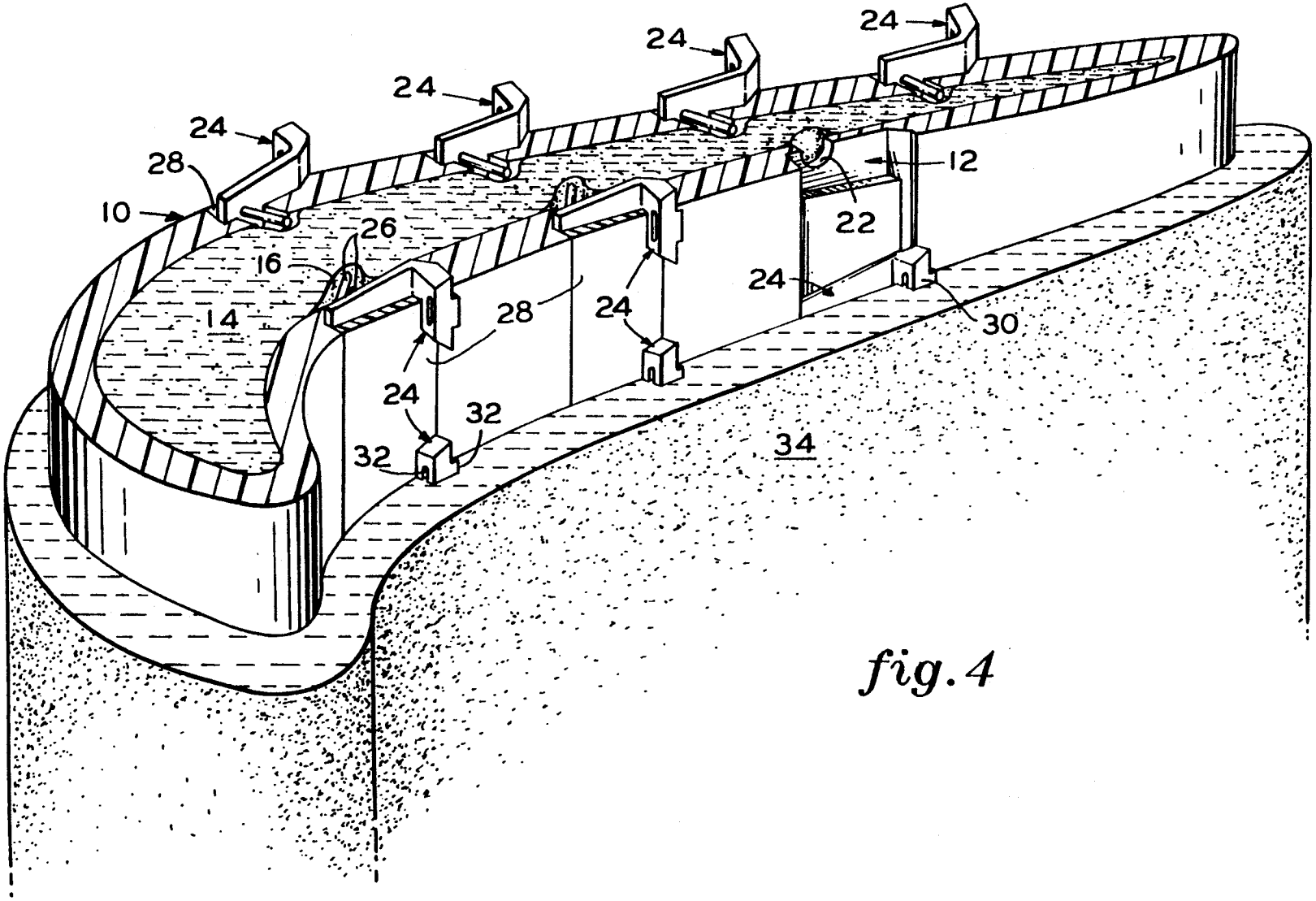
FIG. 4 is a partially sectioned perspective view of a wax pattern with mini cores in position after the ceramic mold has been formed.

The essential feature of this invention is the technique developed for formation of the metering holes which connect the inner and outer airfoil surfaces and control the flow rate of cooling air through the cooling passages. This involves protection of the metering hole pins on the mini core during the mold formation process, and the opening of the metering holes to airflow after the airfoil has been cast. By protecting the pins, the metering holes can be formed during the airfoil casting process, and opened up by a simple machining operation, rather than requiring a separate set of complex operations to machine in the metering holes after the airfoil component has been cast.

Reference is now made to FIG. 2, which shows how the wax pattern 10 is formed with receptacles 12 for mini cores, which ultimately define the configuration of the cooling passages. The inner ceramic core 14 has depressions 16. The wax pattern mold 18 has protrusions 20 which define the receptacles 12 for the mini cores, and includes extensions 22 of the protrusions 20 which form the enlarged receptacle portions which accept the metering hole pins. The protrusion extensions 22 also serve as locating pins to assure that the inner core 14 and the wax pattern mold 18 are held in proper relation to each other during formation of the wax pattern 10. The wax pattern 10 is formed by pouring molten wax into the space between the core 14 and the mold 18.

Referring to FIG. 3, the mini core receptacles 12 are made to provide a fairly tight fit when the mini cores 24 are inserted. The enlarged portions 22 of the receptacles 12, which accept the metering hole pins 26 on the mini cores 24, must be large enough to avoid contact between the pins 26 and the wax pattern 10. This provides a relief zone around the pins 26 so that, after the ceramic mold has been formed around the wax pattern 10, forces generated by expansion of the wax during the heatup portion of the wax removal process are not transmitted to the pins. The mini cores 24 are then held in place by the wax cover plates 28, which are "cemented" in place using molten pattern wax. This cover plate 28 defines a portion of the airfoil outer surface, holds the mini core 24 in position, establishes the thickness of the airfoil wall over the cooling passage, and seals around the mini core 24 to prevent any flow of ceramic mold material into the enlarged portion 22 of the receptacle 12. The extended portions 30 of the mini cores 24 have geometric features 32 which assure that the mini cores 24 are held firmly in place by the ceramic material when the ceramic mold is formed.

Referring now to FIG. 4, the wax pattern 10 has been formed around the necessary internal cores 14, and the mini cores 24 have been installed and fastened in place. The figure shows, for illustrative purposes, a portion of mini core receptacle which has not been filled, and mini cores which are only partially covered with the ceramic mold material to show how the ceramic locks around the extended portion of the mini cores. The assembly is dipped repeatedly into a slurry of ceramic mold material until a ceramic mold 34 of sufficient thickness has been built up. Appropriate additions of a stucco-like material are incorporated into the ceramic mold material to provide additional thickness necessary for mold wall strength and resistance to deformation at the elevated temperatures incurred during the casting process. The wax pattern 10 is then removed, generally by heating to melt or burn out the wax.

Molten metal is then poured into the mold and flows into the cavity left by the removal of the wax pattern. After the metal has solidified, the internal cores and the mini cores are removed by a chemical leaching process which dissolves the core material, leaving the hollow metal casting with the cooling passages in place.

Removal of the excess material on the protrusions which extend beyond the ends of the metering flow pins by an EDM process exposes the ends of the flow holes and opens them up to air flow.

The process of the present invention may be better understood through reference to the following illustrative example.

EXAMPLE I

A wax pattern was prepared for a test piece simulating a wall of a hollow airfoil. The pattern incorporated receptacles for cooling passage mini cores, including enlarged portions into which thin pins extended. The wax pattern was prepared on a substrate which had indentations which formed protrusions surrounding the enlarged receptacle portions.

A ceramic mold was then formed around the wax pattern, and the mold was heated to remove the wax. A casting was then made using a nickel base superalloy, PWA 1484, having a nominal composition of 5.0 Cr, 10 Co, 1.9 Mo, 5.9 W, 3.0 Re, 8.7 Ta, 5.65 Al, 0.10 Hf, balance Ni, where the standard chemical symbols represent the weight percent of each element in the alloy.

After removal of the ceramic mold and cores, it was determined that all of the small pins on the mini cores had survived the mold making process, and formed holes in the metal casting. The excess material on the protrusions was then removed by EDM, and the holes were opened to permit flow.

A similar attempt to cast a sample with the wax pattern in intimate contact with the pins resulted in breakage of approximately 60% of the pins, with consequent failure to produce holes in those locations during the casting process.

EXAMPLE II

A gas turbine engine turbine vane was fabricated using procedures similar to those employed in Example I. In this case, the appropriate cores for the vane cavity and cooling passages were incorporated into the wax pattern. The wax pattern was then formed with enlarged receptacles for the metering hole pins on the mini cores, and protrusions into the vane cavity coincident with the pins on each mini core.

A vane was then cast using PWA 1484 as in the previous example. After removal of the cores, the excess portions of the protrusions in the cavity of the vane were removed by EDM. It was determined that all of the metering hole pins had remained intact during the wax removal and casting processes, and the metering holes had been successfully formed during the casting operation.

Although this process has been described in terms of its application to gas turbine hardware, one of average skill in the art will understand that the principles are applicable to many other situations in which small features on the core can be broken off during the formation of investment casting molds, and that various changes, omissions and additions in form and detail thereof may be made without departing from the spirit and scope of the claimed invention.

We claim:

1. A method for fabrication of a hollow air cooled investment cast gas turbine airfoil component comprising:

a. making a wax pattern having receptacles for mini cores including enlarged receptacle portions to accept pins on the mini cores which form passages connecting the inner surface and the outer surface of the airfoil component, the pin receptacle extending beyond the internal finish dimension of the hollow airfoil component;

b. making the mini cores which have pins longer than necessary to form the required length of the connecting passages;

c. fastening the mini cores in position in the wax pattern with no openings between the pin receptacles and the outer surface of the wax pattern;

d. forming a ceramic mold surrounding the wax pattern;

e. removing the wax pattern from the ceramic mold;

f. casting the hollow airfoil component in the ceramic mold, thus forming a casting having protrusions with excess material in the pin cavity portions;

g. removing the hollow airfoil component from the ceramic mold;

h. removing the mini cores from the hollow airfoil component; and i. removing the excess material from the protrusions, thus exposing the ends of the connecting holes.

2. A method for fabrication of a hollow investment casting having passages connecting the inner surface and the outer surface of the casting comprising:

a. making a wax pattern having receptacles for mini cores including enlarged receptacle portions to accept pins on the mini cores which form the connecting passages, the pin receptacle portions extending beyond the internal finish dimension of the hollow casting;

b. making the mini cores, which have pins longer than necessary to form the required length of the connecting passages;

c. fastening the mini cores in position in the wax pattern with no openings between the pin receptacles and the outer surface of the wax pattern;

d. forming a ceramic mold surrounding the wax pattern;

e. removing the wax pattern from the ceramic mold;

f. casting the hollow investment casting in the ceramic mold, thus forming a casting having protrusions with excess material in the pin cavity portions;

g. removing the metal article from the ceramic mold;

h. removing the mini cores from the metal article; and i. removing the excess material from the protrusions, thus exposing the ends of the connecting holes.

* * * * *